United States Patent [19]

Hughes

[11] Patent Number: 4,949,915

[45] Date of Patent: Aug. 21, 1990

[54] IMPELLER FOR COMMINUTER

[75] Inventor: John H. Hughes, Montesano, Wash.

[73] Assignee: ComCorp, Inc., Montesano, Wash.

[21] Appl. No.: 298,439

[22] Filed: Jan. 18, 1989

[51] Int. Cl.[5] ..... B02C 4/02

[52] U.S. Cl. ..... 241/245; 241/253; 241/257 R; 241/261

[58] Field of Search ..... 241/30, 248, 253, 258, 241/257 R, 27, 260, 225, 261, 228, 235, 236, 86.1, 89.3, 246, 252, 299, 154, 161, 245, 5

[56] References Cited

FOREIGN PATENT DOCUMENTS 1151302 4/1985 Japan ..... 241/257 R

*Primary Examiner*—Mark Rosenbaum

*Attorney, Agent, or Firm*—Christensen, O'Connor, Johnson & Kindness

[57] ABSTRACT

An impeller for use in a comminuter of the type having a cylindrical comminuting chamber formed by a circular arrangement of free rotating vertical cutting rolls includes a circular baseplate rotatably mounted at the lowermost end of the comminuting chamber for horizontal rotation. A first planar impeller blade is affixed at a first end to the plate. The blade extends upwardly at an acute angle from the plate and terminates at a second end closely adjacent the cutting rolls. The first blade is arranged to push the material in the bottom portion of the chamber in the direction of rotation of the baseplate and also to provide a component of force downward on the material. In one embodiment, a second impeller blade is affixed to the plate at a location diametrically opposed to the location of attachment of the first blade. The second blade extends upwardly at an acute angle from the plate and toward the cutter rolls in a direction opposite the first blade and also acts on the material in the comminuter in a downward direction. The blades each have a straight edge that is adjacent the other, but the blades are laterally offset so that they do not intersect. Each blade also has a curvilinear edge that is closely adjacent the cutter rolls. A motor is provided to rotate the impeller plate.

10 Claims, 3 Drawing Sheets

IMPELLER FOR COMMINUTER

BACKGROUND OF THE INVENTION

This invention relates to devices for comminuting materials and particularly relates to an improved impeller for use in a comminuter to impart orbital motion to the material being comminuted.

There are many different types of machines known in the industry for comminuting different types of materials. One such comminuter is the type shown in U.S. Pat. No. 4,366,928 to John H. Hughes, issued Jan. 4, 1983. in the comminuter shown in the Hughes patent, a plurality of upright rollers are arranged to form a comminuting chamber of essentially tubular shape. The material to be comminuted is fed into the upper end of the comminuting chamber and the comminuting action is promoted by orbital movement of the comminuting material about the interior of the comminuting chamber. The centrifugal force of the orbiting material brings the material into contact with the toothed surfaces of the comminuting rollers, which tear and cut the material into smaller particles. Typically, an impeller has been used at the lower end of the comminuting chamber to assist in imparting orbital motion to the materials and, in some cases, the impeller is driven independently of the rolls. In other cases, the impeller is mounted for free rotation and the comminuting rolls are driven so that they impart the motion to the material, when then is maintained in an agitated state by action of the impeller blades.

Although the comminuter of the type shown in the Hughes patent has proved to be an efficient and entirely adequate means for comminuting materials into desired particle sizes, it is an object of the present invention to provide an improved impeller that allows greater and more efficient forces to be brought to bear upon the solid material being comminuted and to more effectively handle the varying sizes of material entered into the comminuting chamber. It is also an object of the invention to provide a comminuter that is more energy efficient and requires a minimum of power to comminute even hard materials.

SUMMARY OF THE INVENTION

In accordance with the present invention, an improved design of impeller for a comminuter is provided. The comminuter includes a plurality of rollers arranged vertically and journaled in a suitable frame to form an upright tubular comminuting chamber. The rollers are preferably arranged in a circle to form a cylindrical chamber and preferably are provided with outwardly projecting puncturing elements to comminute the material by a combination of puncturing and tearing action. The rollers are mounted for free rotation on the frame. An impeller is mounted at the lower end of the comminuting chamber within the enclosure formed by the comminuting rolls. The impeller includes a circular plate mounted in a horizontal plane and a means drivingly connected to the plate for rotating the plate in the horizontal plane. The perimeter of the plate is closely adjacent the exterior surface of the comminuting rollers. The impeller includes at least a first blade having a first end affixed to the horizontal plate. The first blade extends upwardly from the plate and is constructed and arranged so that as the plate rotates the impeller produces a force on the material in the comminuting chamber that has a component tangential to the plate and a component downward toward the plate. In one embodiment the blade extends at an acute agle upwardly and in a direction of rotation of the plate and terminates at a second end closely adjacent the comminuting rollers. An arcuate edge of the blade extends from its first end to its second end and is closely adjacent the perimeter of the rollers, preventing larger particles from falling between the edge of the blade and the rollers. In another embodiment of the impeller, a second blade identical to the first has its first end affixed to the horizontal plate on the opposite side of the plate from the end of the first blade and laterally offset from the point of attachment of the first end of the first blade. The second blade extends upwardly from the plate at an acute angle and in a direction opposite the first blade and also terminates at a second end closely adjacent the perimeter of the comminuting rollers. The first and second blades are arranged in a mutually opposed intersecting orientation.

BRIEF DESCRIPTION OF THE DRAWINGS

The objects and advantages of the present invention will be better understood by those of ordinary skill in the art and others upon reading the ensuing specification, taken in conjunction with the appended drawings wherein.

DETAILED DESCRIPTION OF THE PREFERRED EMBODIMENT

Figure 1:
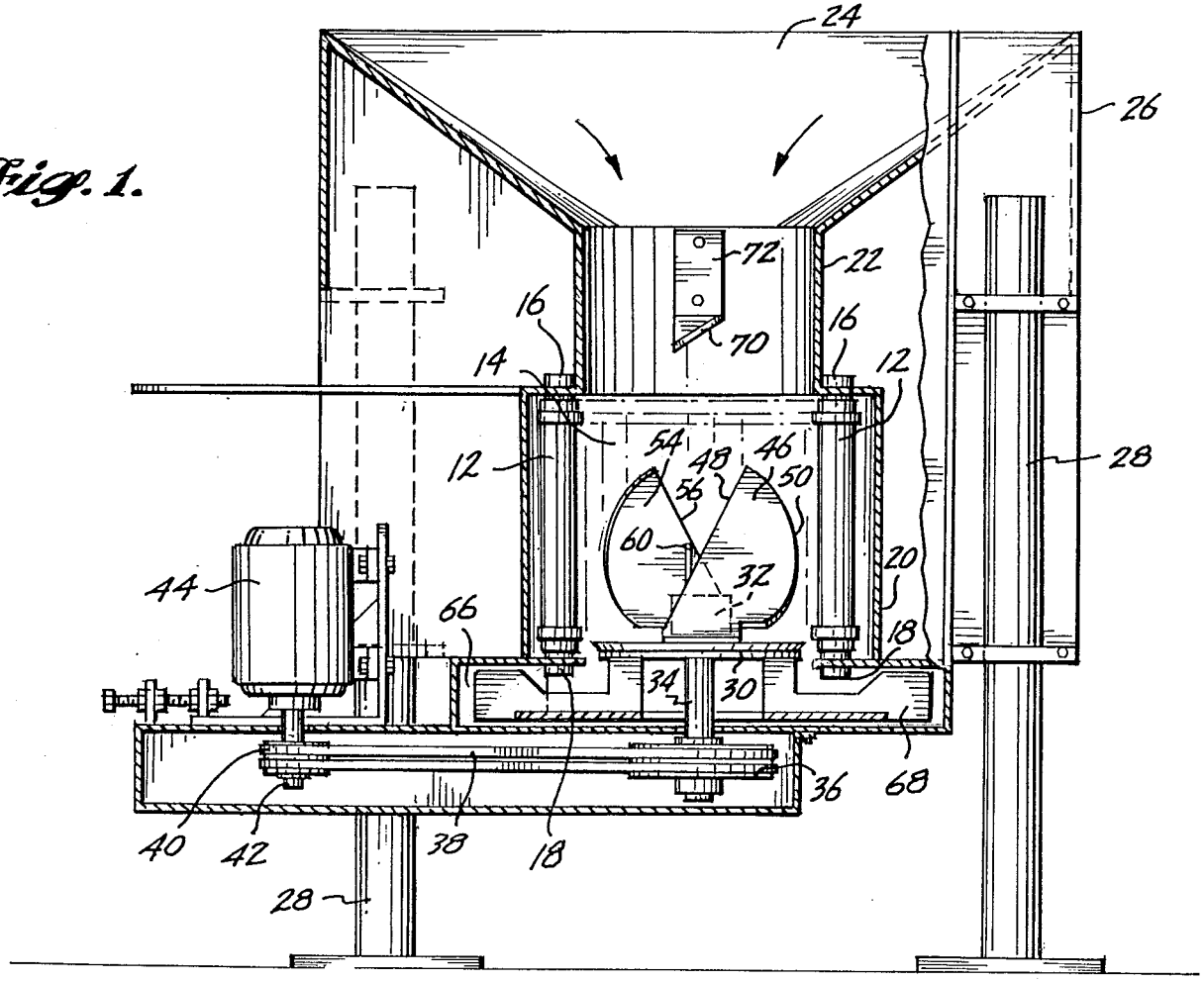
FIG. 1 is a side elevational view in cross section of a comminuter having an impeller made in accordance with the principles of the present invention.

A comminuter for use in reducing solid materials into particles of a predetermined size is illustrated in FIG. 1. The comminuting chamber is formed by a plurality of comminuting rolls 12 vertically mounted in a circular orientation to form a cylindrical comminuting chamber 14. Each of the rolls 12 is mounted in upper bearings 16 and lower bearings 18 for free rotation in a frame 20. An inlet to the comminuting chamber is provided by a cylindrical tube 22, which is open at top and bottom. The bottom of the tube 22 is in communication with the comminuting chamber 14. A hopper 24 is mounted atop the inlet 22 to receive the material to be comminuted and directed into the tube 22, which, in turn, feeds the material into the comminuting chamber 14. The entire comminuter is surrounded by an external housing 26 that is mounted on adjustable leg members 28 to permit leveling of the machine on uneven surfaces.

An impeller baseplate 30 is mounted at the bottom of the comminuting chamber and oriented in a horizontal plane. The baseplate 30 is attached to a hub 32, which, in turn, is affixed to a shaft 34 on which is mounted a pulley 36. Drive belt 38 drivingly engages the pulley 36 and in turn engages a drive pulley 40 mounted to the shaft 42 of a motor 44. The motor 44 therefore drives the pulley 36, which, in turn, drives the impeller baseplate 30.

Figure 2:
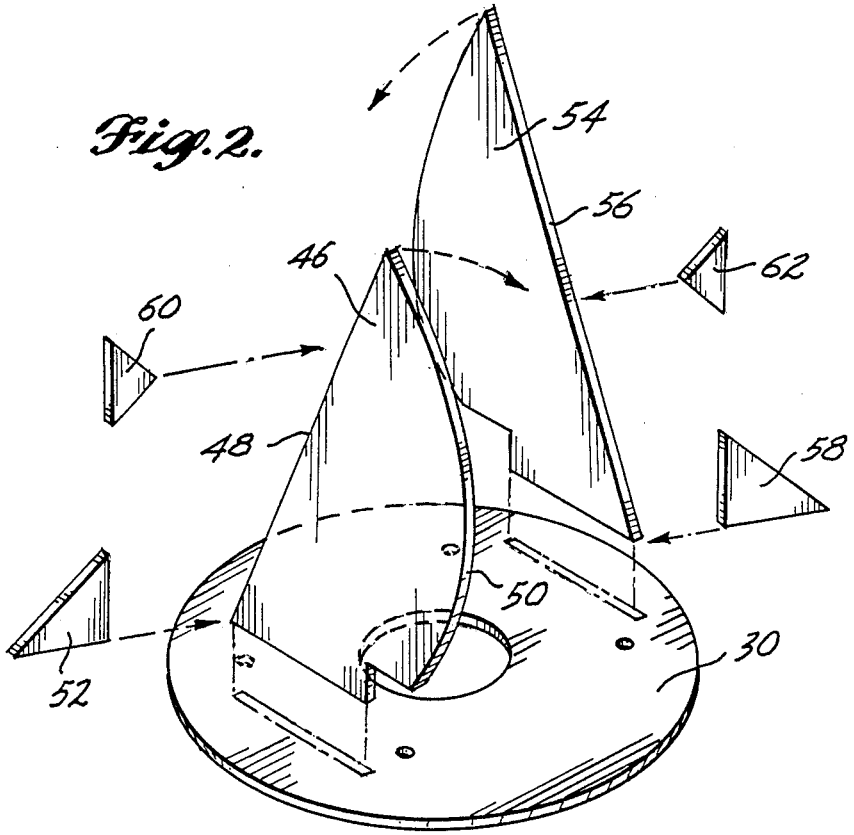
FIG. 2 is an exploded isometric view of the impeller of FIG. 1.
Figure 3:
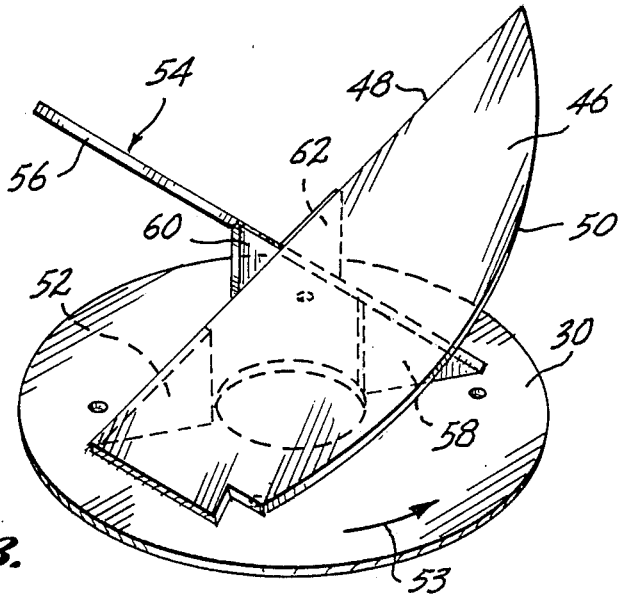
FIG. 3 is an isometric view of the impeller of FIG. 1.

A first impeller blade 46 is affixed at a first end to the impeller baseplate 30. The first impeller blade 46 has a first straight edge 48 and a second, curvilinear edge 50 that intersect at a second end of the impeller blade to form a pointed second end that is elevated above the baseplate and closely adjacent the comminuter rolls 12 such that the impeller blade 46 angles upwardly from the baseplate at some acute angle. The construction of the blade 46 is best seen in FIGS. 2 and 3. A first lower brace 52 in the shape of a right triangle is mounted between the first impeller blade 46 and the baseplate 30 to maintain the orientation of the blade. A first leg of the triangular brace 52 is affixed to the baseplate 30, while the hypotenuse of the triangular brace is affixed to the first edge 48 of the first impeller blade 46. The first impeller blade extends in a direction tangential to the circular motion of the baseplate 30 as shown by arrow 53.

A second impeller blade 54 of substantially the same shape as the first impeller blade 46 is affixed at its first end to the baseplate 30 diametrically opposite the point of attachment of the first end of the first blade 46. The second impeller blade 54 extends upwardly from the baseplate in a direction essentially opposite to the direction of extension of the first impeller blade but also tangential to the rotation of the baseplate 30. The second impeller blade is laterally offset from the first impeller blade so that the first edge 48 of the first impeller blade is adjacent the first edge 56 of the second impeller blade. A second lower brace 58 is mounted between the second impeller blade and the baseplate 30 to maintain the orientation of the second impeller blade. A first upper brace 60 and a second upper brace 62 are respectively mounted between the first and second impeller blades adjacent their point of intersection to further add bracing to the impeller blades and to assist in maintaining the orientation of the first and second impeller blades with respect to one another and the baseplate.

Figure 4:
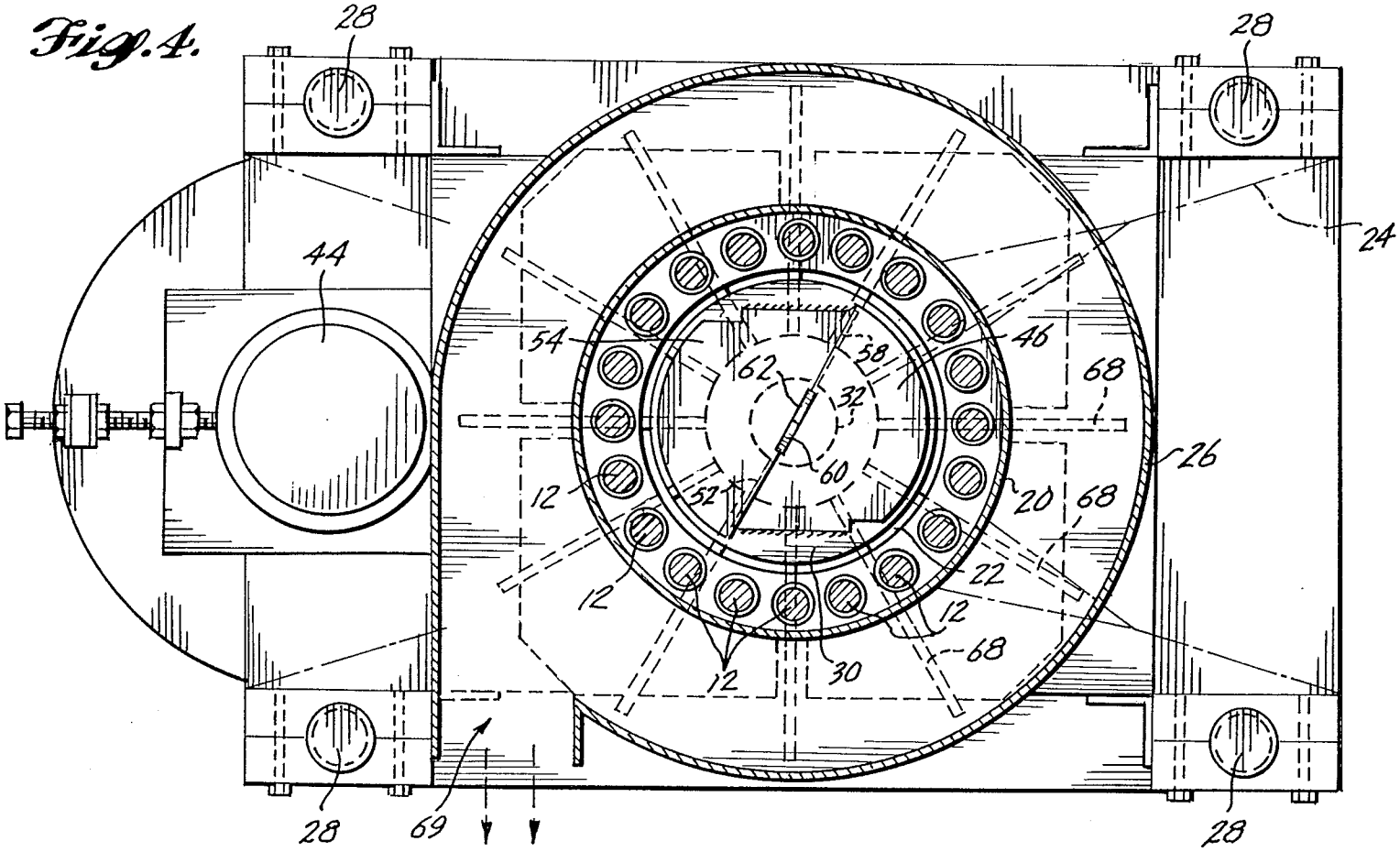
FIG. 4 is a plan view of the comminuter of FIG. 1.

As can best be seen in the plan view of FIG. 4, the impeller baseplate 30 fills substantially all of the cross-sectional area of the comminuting chamber. The curvilinear edge 52 of the first impeller blade and the curvilinear edge 64 of the second impeller blade run closely adjacent the comminuting rolls to inhibit the passage of particles larger than some predetermined size between the impeller blades and the rolls. As material loaded into the hopper 24 works its way down into the comminuting chamber 14, the material moves to a position beneath the impeller blades 46 and 54. The blades 46 and 54 of the impeller impart an orbital motion to the material that induces a centrifugal force to force the material to impinge upon the comminuting rollers 12. Also the inclination of the blades produces a downward force that compacts the material against the baseplate. The abrasive force of the material against the comminuting rollers combined with the cutting action of the teeth projecting from the rollers cause a shredding and tearing action that reduces the material to particles. Because the lower exit from the comminuting chamber is effectively blocked by the impeller baseplate 30, a major avenue for exit of particles from the comminuting chamber 14 is between the rolls 12 or by discharge means that includes having holes in the rolls 12 that gather material and then deposit it in the outer perimeter of the comminuting chamber through centrifugal force that occurs through spinning of the rolls 12. Particles eventually work their way down to openings in the bottom of the frame 20 into a particle collection chamber 66, which is located below the comminuting chamber. An arrangement of paddles 68 is affixed to the underside of the impeller plate 30 and turns in unison with the impeller plate 30, forcing the particles collected in the particle collection chamber 66 out a side chute 69 to be picked up by a conveyor or other means of discharge. In some embodiments a blower can be associated with the comminuter to force the particles from the collection chamber in an airstream that discharges through the side chute 69.

A wide variety of materials can be thrown into the hopper 24 of the comminuter. Some of the pieces of material, such as stumps, may be too large to easily fit within the inlet tube 22 or the comminuting chamber 14. In the illustrated embodiment, a chopper blade 70 is mounted in the upper portion of the inlet chute 22 by means of a hanger 72. The purpose of the chopper blade 70 is to cut any pieces of material that are moving in the comminuting chamber and extending upwardly into the inlet tube 22.

The design of the impeller blades 46 and 54 is such that even large pieces of material can fit beneath the impeller blades. For example, a large piece of wood can fall to a position below the blade 46 or 54 and rest on the bottom plate 30. The wood piece is carried by the bottom plate 30 and pushed by the underside of the blade and rubs against the comminuting rolls 12. The movement of the wood piece against the rolls promotes rotation of the rolls, thereby enhancing the comminuting action. Also, the blades are shaped to act as paddles to provide both a downward and forward force on the material in the comminuter to continually maintain the material in an orbital motion pressed against the comminuter rolls to achieve the greatest efficiency of comminuting action.

The impeller described above has the advantages of maintaining consistent motion of the material to be comminuted in an orbital fashion within the comminuting chamber and imparts sufficient motion to the material that the material is brought in contact with the surfaces of the comminuting rollers lining the comminuting chamber to effect the comminution of the materials. At the same time the impeller produces a downward force on the material in the bottom of the comminuting chamber that has been found to enhance the comminuting action. The design of the impeller allows both large and small pieces of material to move to the bottom of the comminuter and contact the comminuting rolls to aid in turning the rolls and causing comminuting action. While a preferred embodiment of the invention has been described and illustrated, it will be understood by those of ordinary skill in the art and others that changes can be made to the impeller described herein while remaining within the scope of the present invention. For example, the impeller can have a single paddle-shaped blade affixed to the bottom plate, or the two blades can be spaced from one another so that they are not fastened to one another. The key element is that the blades must be shaped or positioned to supply a downward force on the material at the bottom of the comminuting chamber. A vertical blade can be used if it is mounted in conjunction with a horizontal top wing or a horizontal top plate that maintains a vertically directed downward force on the material in the bottom portion of the comminuter. Also, while two blades are illustrated, a single blade or more than two blades can be used. Since changes can be made in the illustrated embodiment while remaining within the scope of the invention, the invention should be defined solely with reference to the appended claims.

The embodiments of the invention in which an exclusive property or privilege is claimed are defined as follows:

1. In a comminuter having a plurality of comminuting rolls vertically mounted for free rotation on a frame, said rolls being arranged in substantially circular fashion to define a cylindrical comminuting chamber and an impeller plate mounted for rotation in a horizontal plane in a lowermost end of the comminuting chamber, an improved impeller comprising:

motor means mounted on said frame and coupling means for drivingly connecting said motor means to said impeller plate to rotatably drive said impeller plate in a first direction; and, a first impeller blade affixed at a first end thereof to the impeller plate, said first impeller blade extending in a direction tangential to said first direction and upwardly at an acute angle from said plate, a second end of said first impeller blade terminating closely adjacent the comminuting rolls, said first impeller blade having a straight edge extending from said first end to said second end thereof and a curvilinear edge extending from said first end to said second end thereof in close proximity to said comminuting rolls.

2. The impeller of claim 1 further including:

a second impeller blade having a first end affixed to said impeller plate at a location diametrically opposite the location of attachment of said first impeller blade, said second impeller blade extending upwardly from said impeller plate and in a direction opposite said first impeller blade but still tangential to said first direction and terminating at a second end closely adjacent said comminuting rolls, said second impeller blade having a straight edge extending from its first end to its second end and a curvilinear edge extending from its second edge to its first edge closely adjacent said comminuting rolls, said first and second impeller blades being laterally offset from one another so that the respective straight edges of said blades are adjacent one another but said blades do not intersect.

3. The comminuter of claim 2, wherein the distance from said impeller plate to the second ends of said first and second impeller blades is greater than half the length of said comminuting rolls.

4. The comminuter of claim 3, further including upper brace means affixed to said first and second impeller blades substantially adjacent the point at which their straight edges cross to maintain the relation between said first and second impeller blades.

5. The comminuter of claim 2, further including a lower brace affixed between said impeller plate and a lower surface of said first impeller blade to support said impeller blade against the force of the material in the comminuting chamber and a second brace mounted between said impeller plate and a bottom surface of said second impeller blade to maintain the position of said impeller blade against the force of the material within said comminuting chamber.

6. The comminuter of claim 1, further including a cutting blade mounted on said frame above said comminuting chamber and oriented to engage any material within said comminuting chamber that extends past the uppermost boundary of said comminuting chamber.

7. In a comminuter of the type having a plurality of comminuting rolls vertically mounted for free rotation on a frame, said rolls being arranged in substantially circular fashion to define a cylindrical comminuting chamber and including a circular impeller plate mounted for rotation in a horizontal plane in a lowermost end of the comminuting chamber, and improved impeller comprising:

motor means mounted on said frame and coupling means for drivingly connecting said motor means to said impeller plate to rotatably drive said plate in a first direction; and an impeller blade affixed at a first end thereof to said impeller plate, said impeller blade being constructed and arranged to produce a force on material in a bottom portion of the comminuting chamber having a component tangential to the direction of rotation of said impeller plate and a vertical, downward component.

8. The impeller of claim 7 wherein said impeller blade extends upwardly from said impeller plate at an acute angle and extends in the direction of rotation of said impeller plate.

9. The impeller of claim 8 including a second impeller blade mounted on said plate, laterally spaced from said first blade and extending upwardly from said plate in the direction of rotation of said plate.

10. The impeller of claim 7 wherein said blade is mounted on a diameter of said plate.

* * * * *